US008803933B2

(12) United States Patent
Mori

(10) Patent No.: US 8,803,933 B2
(45) Date of Patent: Aug. 12, 2014

(54) PRINTING APPARATUS AND PRINTING METHOD

(71) Applicant: Toshiba TEC Kabushiki Kaisha, Tokyo (JP)

(72) Inventor: Futoshi Mori, Shizuoka-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/955,437

(22) Filed: Jul. 31, 2013

(65) Prior Publication Data

US 2014/0055547 A1 Feb. 27, 2014

(30) Foreign Application Priority Data

Aug. 21, 2012 (JP) ..... 2012-182303

(51) Int. Cl.
*B41J 17/28* (2006.01)

(52) U.S. Cl.
USPC ..... 347/217

(58) Field of Classification Search
USPC ..... 347/171, 188, 189, 190, 197, 214, 215, 347/217, 218
See application file for complete search history.

(56) References Cited

U.S. PATENT DOCUMENTS

| | | | | |
|---|---|---|---|---|
| 5,210,547 | A * | 5/1993 | Watanabe et al. | 347/188 |
| 5,943,085 | A | 8/1999 | Higashi et al. | |
| 6,109,804 | A | 8/2000 | Higashi et al. | |
| 2006/0279624 | A1 * | 12/2006 | Tsuchiya et al. | 347/218 |
| 2009/0086006 | A1 * | 4/2009 | Koyabu et al. | 347/197 |
| 2010/0309276 | A1 * | 12/2010 | Takizawa et al. | 347/215 |

FOREIGN PATENT DOCUMENTS

| | | |
|---|---|---|
| JP | 10-291707 | 11/1998 |
| JP | 2005-059233 | 3/2005 |
| JP | 2006-264907 | 10/2006 |

OTHER PUBLICATIONS

Japanese Office Action for Japanese Patent Application No. 2012-182303 mailed on Mar. 18, 2014.

* cited by examiner

*Primary Examiner* — Kristal Feggins
(74) *Attorney, Agent, or Firm* — Amin, Turocy & Watson, LLP

(57) ABSTRACT

In accordance with an embodiment, a printing apparatus includes a conveying section configured to move a recording medium fed from a paper roll along a conveyance path, a thermal head configured to thermally transfer ink of an ink ribbon to the recording medium to print, a control section configured to discriminate a print mode for the recording medium and control the printing processing for the recording medium and a feed length counting section configured to count the feed length of the recording medium conveyed from the paper roll to the thermal head in a first direction when the print mode is a preset mode.

5 Claims, 6 Drawing Sheets

PRINTING APPARATUS AND PRINTING METHOD

CROSS-REFERENCE TO RELATED APPLICATION

This application is based upon and claims the benefit of priority from Japanese Patent Application No. 2012-182303, filed Aug. 21, 2012, the entire contents of which are incorporated herein by reference.

FIELD

Embodiments described herein relate to a printing apparatus and a printing method for printing a bar code and the like on a recording medium utilizing an ink ribbon and the like and realizing charging function.

BACKGROUND

Generally, as a printing apparatus for printing a bar code and the like on a recording medium (label paper) utilizing an ink ribbon and the like, a thermal printer such as a label printer and a bar code printer is known. The thermal printer comprises a thermal head, wherein a plurality of heat generating elements is arranged in a direction (namely a horizontal scanning direction) orthogonal to a conveyance direction of a label paper.

The thermal head is configured opposite to a platen roller and is used for conveying the label paper fed by a paper roll along a conveyance path and pressing the label paper and the ink ribbon which are clamped between the thermal head and the platen roller; and a drive motor drives the platen roller to rotate so as to convey the label paper and the heat generating elements of the thermal head are enabled to be in contact with the ink ribbon so as to thermally transfer the ink of the ink ribbon to the label paper. The ink ribbon is rolled up around an ink ribbon winding roller while moving along the conveyance path. (See Japanese Unexamined Patent Application Publication No. Hei 10-157244).

However, in the conventional printing apparatus, there is no other way to confirm the number of utilized label paper but by carrying out visual observation on the residual volume of the paper roll. As a result, the utilization amount of the label paper cannot be counted precisely and the charging cannot be carried out correctly if charging corresponding to the utilization amount of the label paper is wanted.

DETAILED DESCRIPTION

In accordance with an embodiment, a printing apparatus includes a conveying section configured to move a recording medium fed from a paper roll along a conveyance path, a thermal head configured to thermally transfer ink of an ink ribbon to the recording medium to print, a control section configured to discriminate a print mode for the recording medium and control the printing processing for the recording medium and a feed length counting section configured to count the feed length of the recording medium conveyed from the paper roll to the thermal head in a first direction when the print mode is a preset mode.

The embodiments are described below with reference to the accompanying drawings in detail. In addition, the same part is marked with the same sign in each drawing.

A First Embodiment

Figure 1:
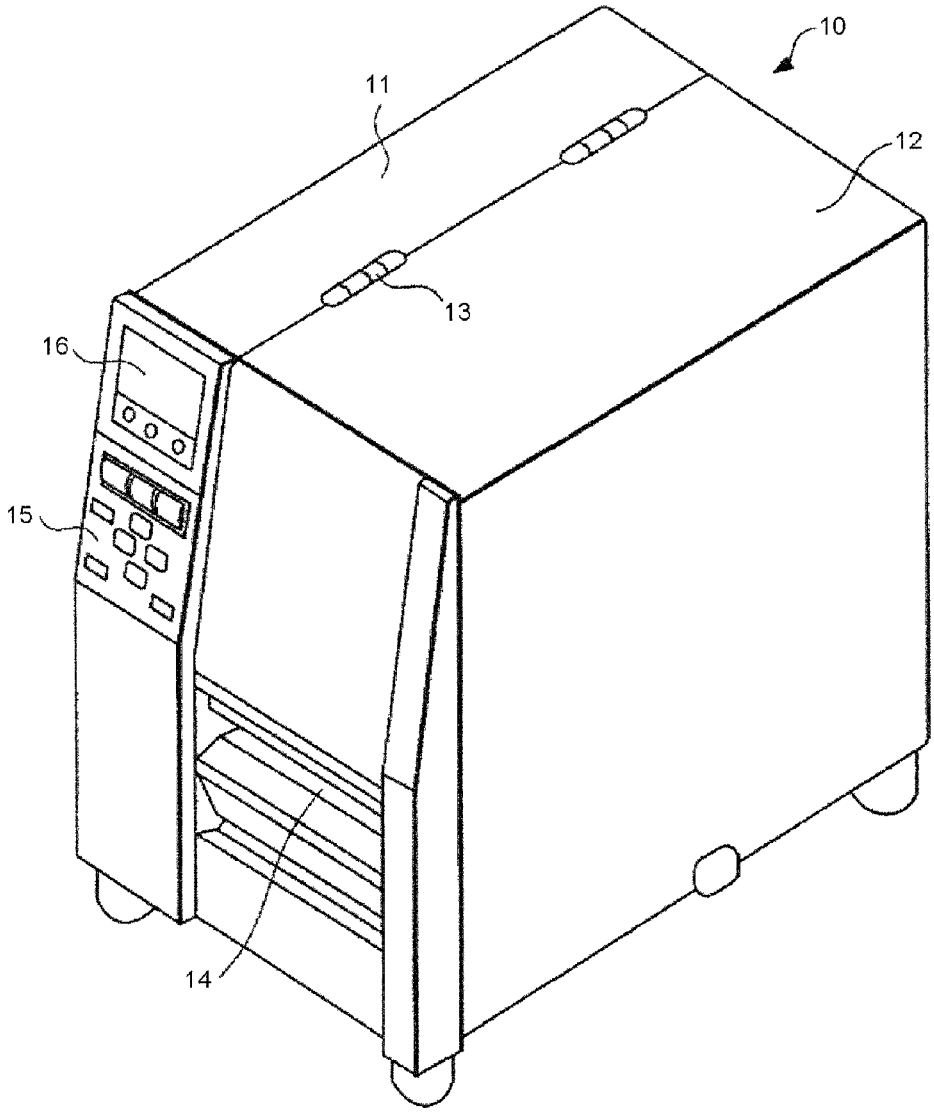
FIG. 1 is a perspective view illustrating a whole configuration of a printing apparatus according to one embodiment.

FIG. 1 is a perspective view illustrating a whole configuration of a printing apparatus according to one embodiment. In FIG. 1, a printing apparatus 10 includes a control box 11 for storing a printer engine and a cover 12 which is rotatably connected with the control box 11 by a hinge 13. In addition, a discharge port 14 for discharging the printed recording medium (label paper) is arranged on the front surface of the cover 12, and an operation section 15 and a display section 16 for displaying operation information and an operation menu are arranged on the front surface of the control box 11. The display section 16 comprises a liquid crystal screen and the like.

Figure 2:
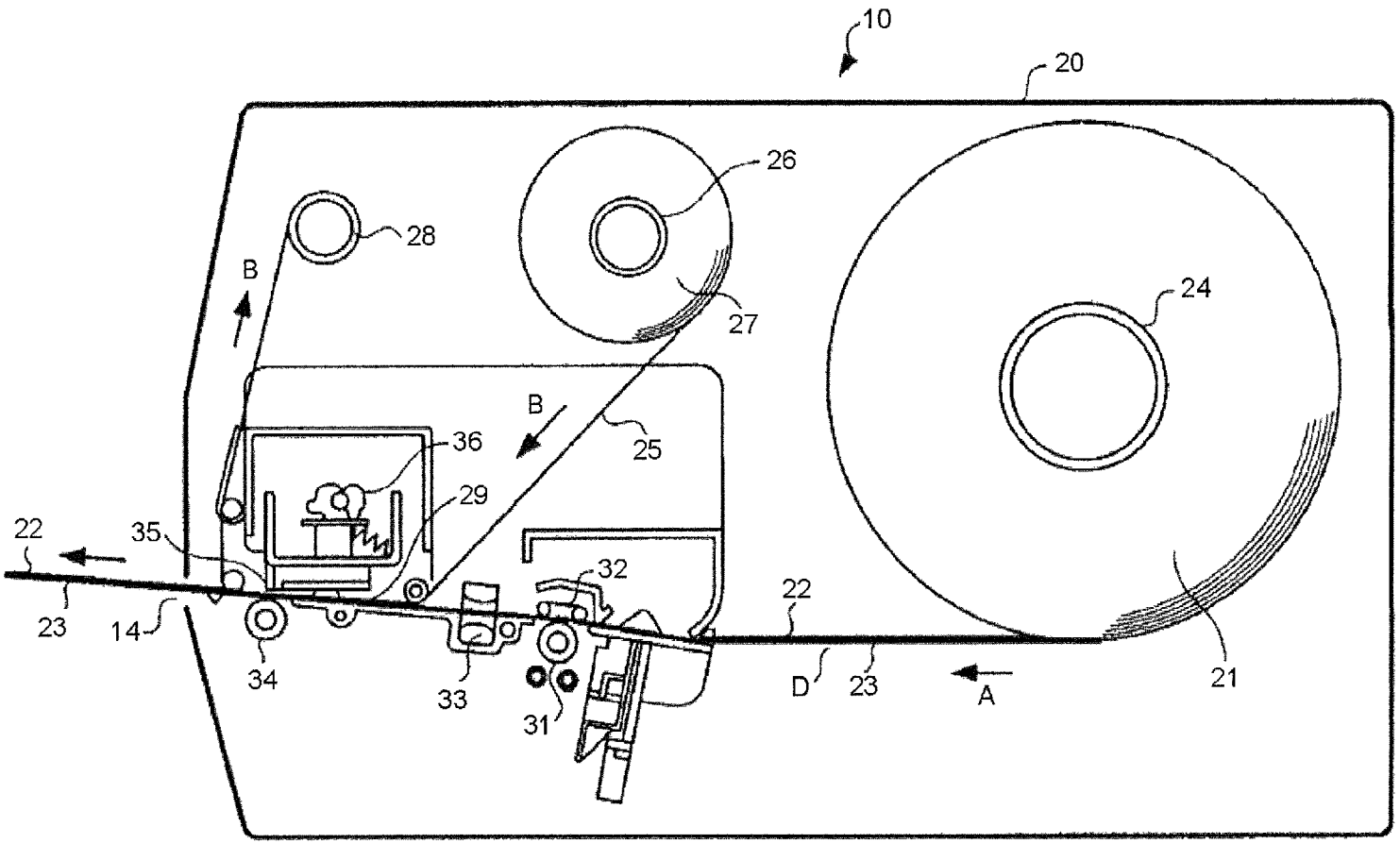
FIG. 2 is a configuration diagram illustrating an internal structure of the printing apparatus according to one embodiment.

FIG. 2 is a configuration diagram illustrating an internal structure of the printing apparatus 10, and shows an opening state of the cover 12 of the FIG. 1.

In FIG. 2, a paper roll 21 is housed in a housing 20 and is rotatably retained on a holding section 24. The paper roll 21 is formed by rolling up mount 23 with a label paper 22 serving as the recording medium in a roll shape and the mount 23 faces outwards. In the label paper 22, an adhesive layer is arrange at a face contacting with mount 23, and the label paper 22 can be peeled off from the mount 23 if needed. Hereinafter, the label paper 22 and the mount 23 are collectively referred to as paper D. The paper D is conveyed in a direction of arrow A in FIG. 2.

In addition, the interior of the housing 20 includes an ink ribbon roll 27 that rewinds an ink ribbon 25 onto a ribbon feed shaft 26, and a ribbon winding shaft 28 that rewinds and retains the ink ribbon 25 fed from the ink ribbon roll 27. The ink ribbon 25 fed from the ink ribbon roll 27 is fed in a direction of arrow B and is rewound onto the ribbon winding shaft 28 through a conveyance path 29.

Furthermore, the interior of the housing 20 includes: a conveyance roller 31 conveying the paper D fed from the paper roll 21, a pinch roller 32, a paper detection sensor 33 detecting the paper D, and a platen roller 34 conveying the ink ribbon 25 and paper D. The conveyance roller 31, the pinch roller 32 and the platen roller 34 and the like are in a conveyance path of the paper D. Also, the conveyance roller 31, the pinch roller 32 and the platen roller 34 and the like constitute a conveying section that conveys the paper D fed from the paper roll 21 along the conveyance path.

A thermal head 35 is arranged opposite to the upper side of the platen roller 34. The ink ribbon 25 and the paper D are sandwiched between the platen roller 34 and the thermal head 35. The thermal head 35 is fixed at the undersurface of a lift mechanism 36, and heat generating elements are arranged at the apical portion of the undersurface of the thermal head 35.

Along an axis direction of the platen roller 34, multiple heat generating elements are arranged at a specified interval in a direction (horizontal scanning direction) which is perpendicular to the conveyance direction of the label paper 22.

An ink ribbon conveyance path 29 feeds the ink ribbon 25 wound around the ink ribbon roll 27 towards the label paper 22. The ink ribbon 25 changes its direction to upward and is rewound onto a ribbon winding shaft 28 after passing through the space between the platen roller 34 and the thermal head 35 at a state of overlapping on the label paper 22.

The thermal head 35 is raised and declined against the platen roller 34 by a lift mechanism 36. When the thermal head 35 declines, the ink ribbon 25 and the label paper 22 are pressed onto the platen roller 34, and ink is thermally transferred from the ink ribbon 25 to the label paper 22 to print. Also, if the thermal head 35 raises, it departs from the platen roller 34 to stop printing. The printed paper D is discharged from the discharge port 14.

Figure 3:
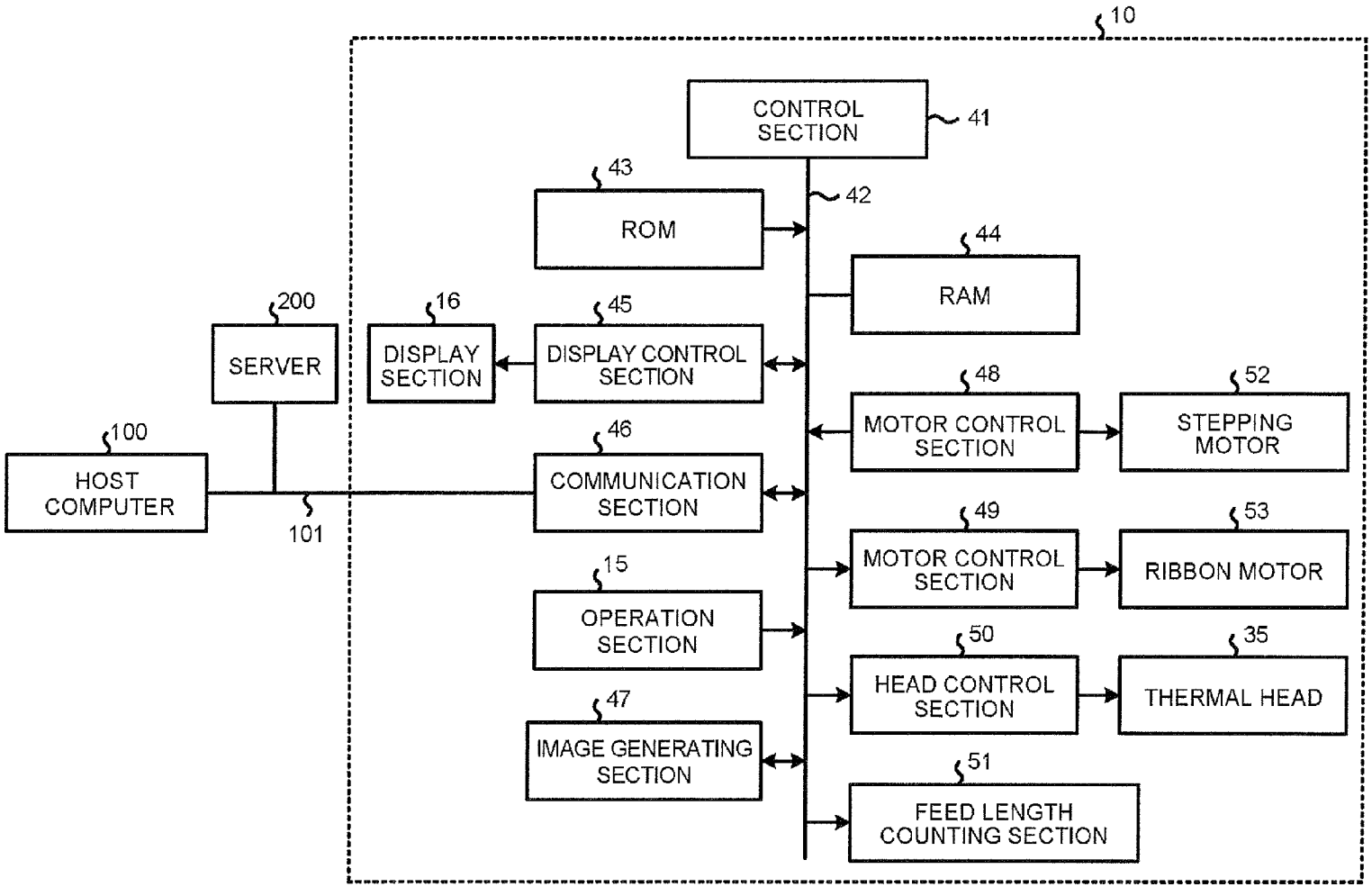
FIG. 3 is a block diagram illustrating a control system of the printing apparatus according to one embodiment.

FIG. 3 is a block diagram illustrating a control system of the printing apparatus 10 according to one embodiment. In FIG. 3, the printing apparatus 10 includes a control section 41 to which a ROM (Read Only Memory) 43, a RAM (Random Access Memory) 44, a display control section 45, a communication section 46, an operation section 15 and an image generating section 47 are connected through a bus line 42.

The control section 41 comprises a CPU controlling all the actions. Operating information or setting information and action method and the like are stored in the ROM 43, and various processing information are stored in the RAM 44. The display control section 44 controls the display section 16, and the communication section 46 carries out communication with a host computer 100 arranged outside and the like. The communication section 46 is connected with a network 101, such as LAN and the like, and the network 101 is connected with a server 200. The server 200 communicates with the communication section 46 through, for example, a SNMP (Simple Network Management Protocol).

The operation section 15 comprises, for example, various input keys for an operator manually inputting data. An image generating section 47 generates a label image to be printed onto the label paper 22, for example, an image of barcode or QR code (registered trademark) and the like. That is, an image buffer according to a specified paper size is offered within the image generating section 47, and a two-dimensional code such as barcode or character are drawn into the image buffer, and the data drawn into the image buffer are transported to the thermal head 35 for each line to carry out printing in the label paper 22 of the paper D.

Furthermore, motor control sections 48, 49, a head control section 50 and a feed length counting section 51 are connected to the bus line 42. The motor control section 48 controls the rotation of a stepping motor 52 driving the rotation of the paper roll 21 or the conveyance roller 31 constituting the conveying section, the pinch roller 32, the platen roller 34 and the like. Also, the motor control section 49 controls the rotation of the ribbon motor 53 driving the ribbon winding shaft 28.

The head control section 50 controls the lift mechanism 36 to raise and decline the thermal head 35, and carries out the control of printing or non-printing onto the label paper 22. Also, the head control section 50 controls heat generating state of the heat generating elements of the thermal head 35. The feed length counting section 51 counts the feed length of the paper D conveyed from the paper roll 21 to the thermal head 35 according to a print mode printing on the label paper 22, which is described in detail later.

The printing apparatus 10 of FIG. 3, under the control of the control section 41, according to an instruction from the operation section 15 or the host computer 100, prints ink onto the label paper 22 as a recording medium by the thermal head 35, and conveys the printed paper D towards the discharge port 14 and discharges the printed paper D. When printing onto the label paper 22, the operator operates the operation section 15, and displays a menu screen and the like onto the display section thereby instructing a print mode. Alternatively, the instruction of the print mode is carried out according to an input from the host computer 100. The control section 41 discriminates the instructed print mode and controls the printing processing of the label paper 22.

Figure 4:
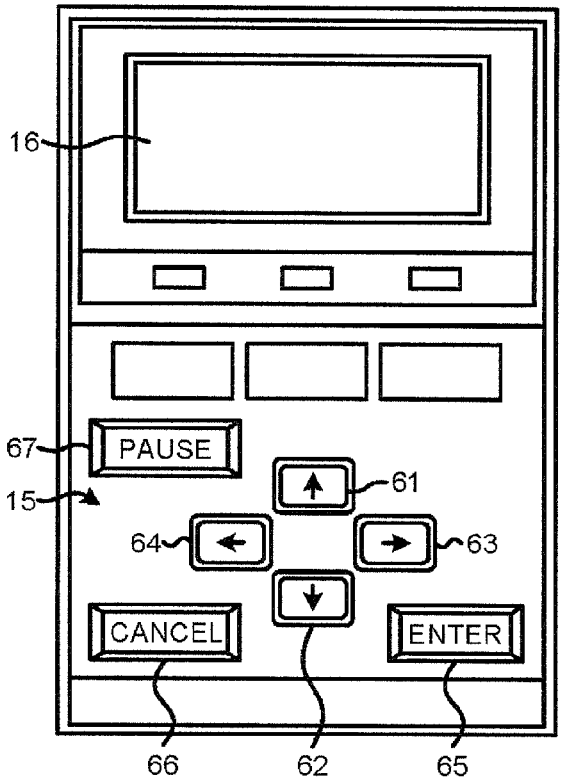
FIG. 4 is an enlarged front view of an operation section and a display section of the printing apparatus according to one embodiment.

FIG. 4 is an enlarged front view of the operation section 15 and the display section 16 of FIG. 1. In FIG. 4, the operation section 15 comprises an Upward cursor key 61, a Downward cursor key 62, a Rightward cursor key 63, and a Leftward cursor key 64. Also, the operation section 15 comprises an Enter key 65, a Cancel key 66, a Pause key 67 and the like.

However, since the charging is based on the amount of the paper D used by the user when rents the printing apparatus 10, the utilization amount of the paper D needs to be precisely counted. Furthermore, the utilization amount of the paper D needs to be clearly shown for the user.

The printing apparatus 10 according to the embodiment comprises the feed length counting section 51 as shown in FIG. 3 in order to charge by precisely counting the utilization amount of the paper D. The actions of the feed length counting section 51 are specifically described below.

The feed length counting section 51 counts, in a preset print mode (charge mode), the feed length of the paper ID conveyed from the paper roll 21 to the thermal head 35 in a first direction when the stepping motor 52 rotates, and displays a counted result on the display section 16. However, the feed length isn't counted in when the stepping motor 52 rotates in a contrary direction. And a plurality of modes (non-charge modes) which doesn't count the feed length exists and is described below. Furthermore, the conveyance of the paper D in the contrary direction when the stepping motor 52 rotates in the contrary direction is called back feed below.

The feed length counting section 51 comprises a counter for counting the feed length of the paper D and counts the feed length of the paper ID according to the length of a label designated by a command, for example, when the label paper 22 is printed and issued, a pitch of the utilized label images is designated by the command. In addition, the number of printings is also designated by the command. The feed length of the paper D and the utilization amount of the label paper are counted by multiplying the pitch of the label images by the number of printings.

Figure 5:
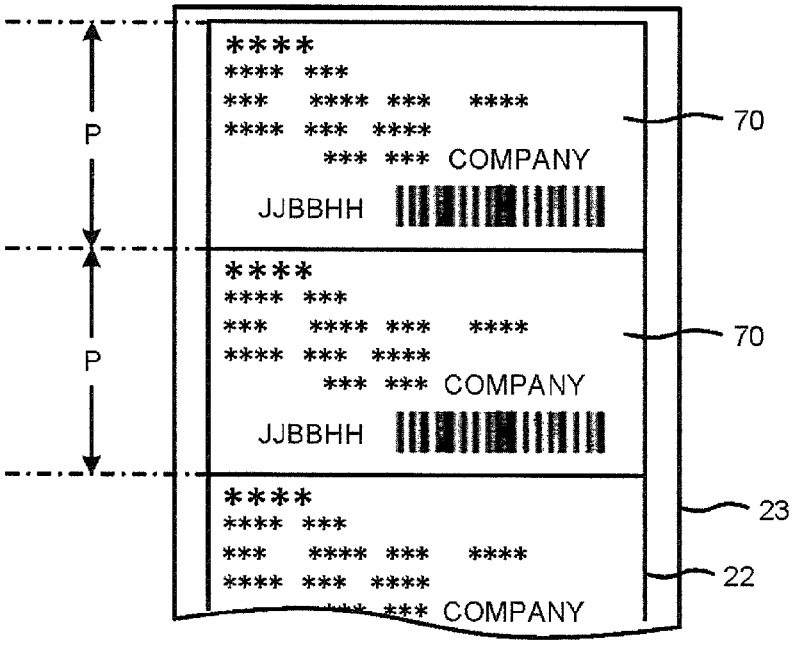
FIG. 5 is an illustration diagram shows an example of printing on a label paper in one embodiment.

FIG. 5 shows an example of printing a label image 70 with the label length of the pitch P on a label paper. The label image 70 is an image including two-dimensional codes and characters. For example, if ten labels printed with the label image 70 of 76 mm pitch are issued, 760 mm (76 mm*10=760 mm) label paper 22 are conveyed. Therefore, the counter of the feed length counting section 51 counts the counting value of 760 mm. In addition, when the designated printing is ended, the value of the counter is reset when a new command is input.

The printing apparatus 10 may count the feed length of the paper D according to the rotation amount of the stepping motor 52, therefore, the printing apparatus 10 sequentially conveys the paper D at an interval of designated pitch P to print on the label paper 22 and discharges the label paper when the designated printing is ended. Therefore, the charging can be carried out by multiplying the feed length (for example 760 mm) counted by the feed length counting section 51 by a certain charge when the printing apparatus 10 is lent with charge.

A charging process is carried out, for example, in the server 200. The server 200 stores the feed length counted by the feed length counting section 51 for each user, sets the charge based on the counted feed length and presents the utilization amount (namely the feed length or the charge) to the user. Therefore, the server 200 constitutes a presenting section capable of presenting at least one of the feed length counted by the feed length counting section 51 and the charge set based on the feed length to a user.

The charge on the utilization amount of the user from the server 200 can be carried out through the network 101. Also, the charge on the utilization amount can be sent by mail. Alternatively, the utilization amount (namely the feed length or the charge) of the present time may be presented corresponding to the request from the user.

In addition, the charge processing may be carried out by the control section 41. The control section 41 sets the charge based on the feed length counted by the feed length counting section 51 and displays on the display section 16 so as to present the utilization amount (namely the feed length or the charge) to the user. Therefore, when the charge processing is carries out by the control section 41, the control section 41 and the display section 16 constitutes the presenting section capable of presenting at least one of the feed length counted by the feed length counting section 51 and the charge set based on the feed length to the user.

Figure 6:
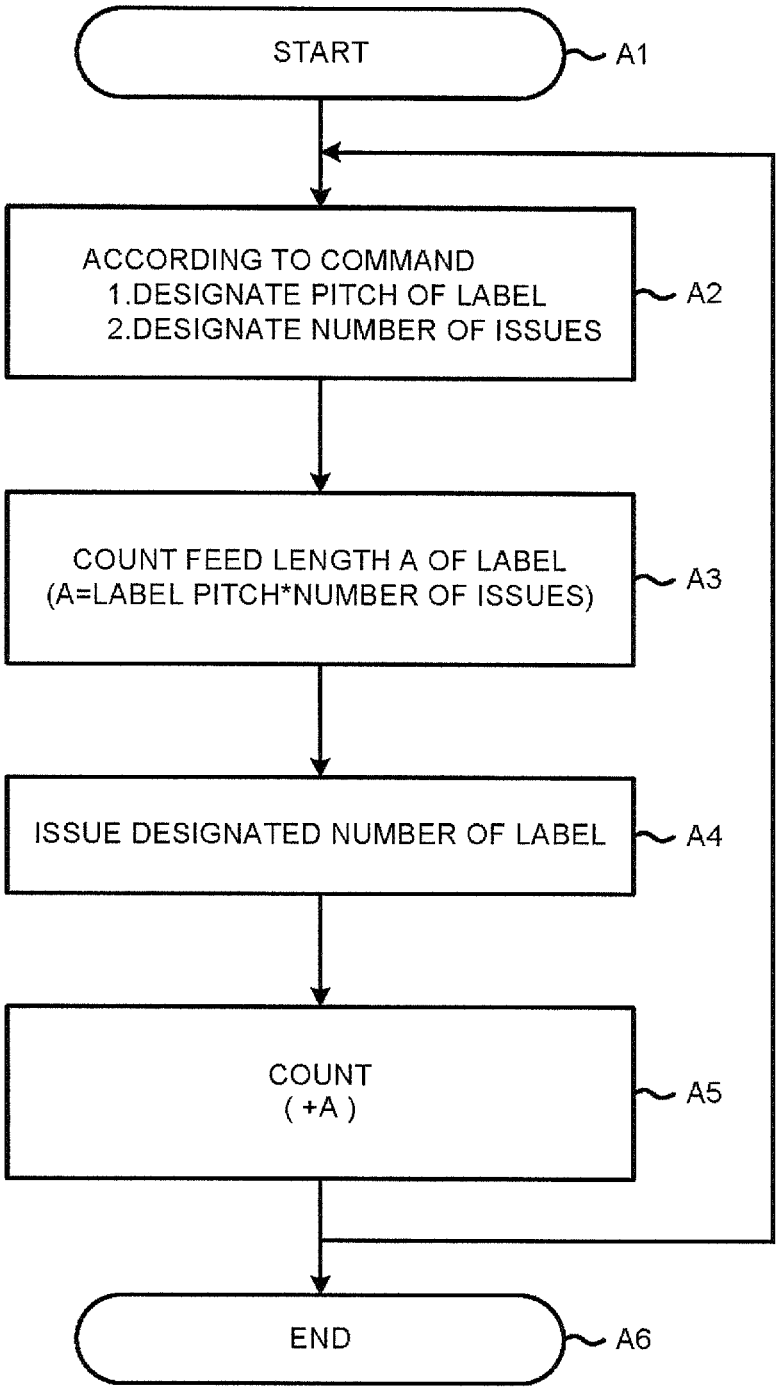
FIG. 6 is a flowchart illustrating actions of counting feed length of the label paper in one embodiment.

FIG. 6 is a flowchart illustrating the actions of counting feed length of the paper D and designating a command. In FIG. 6, ACT A1 indicates a start in a preset print mode; and in ACT A2, the pitch P of the label image and the number of issues of the labels are designated by the command. The designation of the pitch P and the number of issues is carried out by displaying the menu screen on the display section 16, selecting a charge mode and inputting from the key of the operation section 15, or by inputting from the host computer 100.

In ACT A3, the feed length (A) is counted by the feed length counting section 51 and is represented by a formula of (A=label pitch P*number of issues). In ACT A4, the designated number of the label images 70 is printed on the label paper 22 and then is discharged.

In ACT A5, values (A) counted in ACT A3 are added. For example, when a former data of the feed length (X) at the time of printing by the same user is existed, the new feed length (A) is added to the former counted feed length (X). In addition, when a printing instruction is carried out, the flow returns to ACT A2 to carry out the same processing, and then the printing processing is ended in ACT A6.

The feed length counted by the actions from ACT A2 to ACT A6 is sent to the server 200 through the communication section 46, and is stored in the server 200 for each user. The server 200 counts the charge based on the feed length and asks for charges from the user through the network 101 or presents the charges corresponding to the request of the user.

For managing the utilization amount for each user, the printing apparatus 10 comprises a user authentication function so as to discriminate the user or a department by inputting identification number for identifying the user or a department or inserting an ID card when the user utilizes the printing apparatus 10. When a usage is limited to an individual or a specific department, the user need not require an authentication.

In addition, when the printing using the printing apparatus 10 is ended, the feed length of the paper D can be displayed on the display section 16 or can be printed on the label paper 22.

Figure 7:
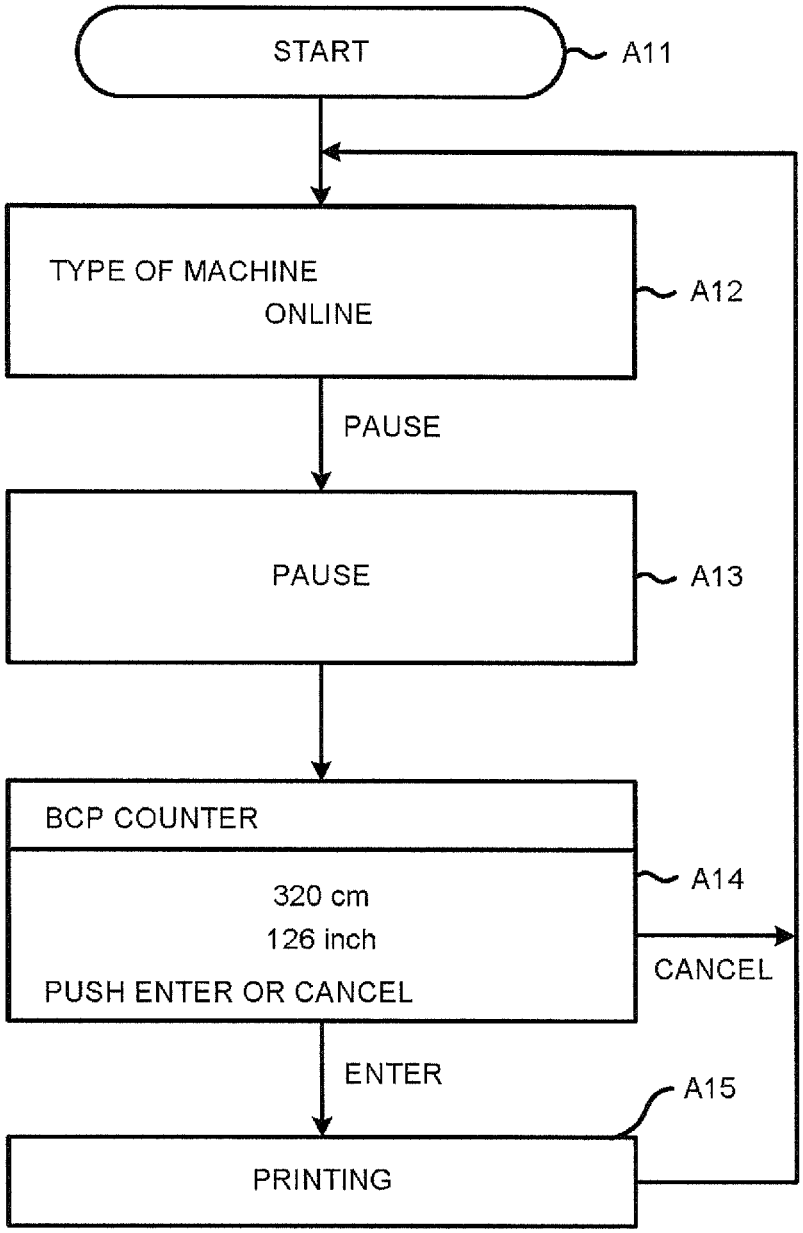
FIG. 7 is a flowchart illustrating actions of displaying and printing the feed length in one embodiment.

FIG. 7 is a flowchart illustrating actions of displaying the feed length of the paper D or printing the feed length of the paper D on the label paper 22 after the printing is ended, and illustrating the displaying or printing processing of the feed length through the control section 41. FIG. 7 is described with reference to FIG. 4.

In FIG. 7, ACT A11 indicates a start, and in Act A12 the power supply of the printing apparatus 10 is turned on. The printing apparatus 10 is in an online state when the power supply is turned on, and then press the pause button 67 first. It is in pause state in ACT A13. If a specified key, for example, the upward cursor key 61 is pressed for more than three seconds in the pause state, a count value of the feed length counting section 51 is displayed on the display section 16 in ACT A14. For example, the feed length of the paper D is displayed to be 320 cm and 126 inch.

After the displayed content in ACT A14 is confirmed, if the cancel key 66 is pressed, the flow returns to ACT A12 to end with the display confirmation without printing. If the enter key 65 is pressed, the flow proceeds to ACT A15 to print the feed length (320 cm and 126 inch) on the label paper 22 and output. In addition, the flow returns to ACT A12 to wait for the next instruction after ACT A15.

In addition, in ACT A14, the charge instead of the feed length can be displayed, or both of the charge and the feed length can be displayed; and in the same way, in ACT A15, the charge instead of the feed length can be printed, or both of the charge and the feed length can be printed.

Furthermore, the non-charge modes of not counting the feed length comprise the following modes:

(a) a cut mode: a condition of configuring a cutter at an outlet of the discharge port 14 and cutting the paper D exists; in the cut mode, when the designated printing is ended, the paper D is temporarily conveyed to the discharge port 14 and then is discharged and cut; after being cut, the paper D is slightly fed back (rewound), and the printing is carried out again from the cut position. Therefore, when the feed length of the paper is counted, the feed length of part from the printing position to the cut position and the feed length of fed back part from the cut position to the printing position are not counted.

(b) a mount peel-off mode: in the example of FIG. 2, an example of discharging the printed paper D from the discharge port 14 is described, but a condition that a mount peeling guide is arranged in the vicinity of the discharge port 14 in the housing 20 exists. The mount peeling guide peels the label paper 22 off the mount 23 by bending the paper D just before the discharge port 14 at a steep angle, and the peeled label paper 22 is discharged from the discharge port 14, and the mount 23 is rewound by a mount rewinding mechanism. Therefore, in the mode where the mount peeling guide is arranged to peel off the label paper, since the paper D is temporarily conveyed to a peeling position, and after that the paper D is fed back to the printing position to restart the printing, therefore, during the conveyance from the printing position to the peeling position and the conveyance from a rewinding position to the printing position, the feed length is not counted.

(c) a maintenance mode: when being maintained, the printing apparatus 10 is in an offline mode, in order to confirm the state of the printing apparatus 10, the paper D is conveyed in the first direction (forward), or the paper D is rewound to be printed, therefore, the feed length is not counted in the maintenance mode.

(d) a manual rewind mode: the printing apparatus 10 acts under the control of the control section 41 in a common mode, but, for example, when the printing position is designated, the paper D is fed forward or fed back. Therefore, in the manual mode, the feed length is not counted no matter the paper D is fed forward or fed back.

(e) an automatic calibration mode: the automatic calibration mode is a mode for detecting the length of a space between labels, and in the automatic calibration mode, the paper D is fed forward and fed back in order to measure the length of the space between the labels. Therefore, the feed length in the automatic calibration mode is not counted.

(f) an auto forward wait mode: the auto forward wait mode is a mode for feeding the paper D forward to the printing position to be standby after the printing is ended, and in the auto forward wait mode, the feed length is not counted.

(g) an error mode: in the midway of the printing processing, for example, when the ink ribbon 25 of the ink ribbon roll 27 is used up, an error occurs. At this time, the paper D is conveyed at the length of a whole label paper 22 to restart the printing from the next label paper 22. Therefore, the feed length of the paper conveyed when the error occurs to the position where the printing is restarted is not counted. And in the same way, when the paper D of the paper roll 21 is used up and the error occurs, the feed length is also not counted.

(h) a mode of writing information to a RFID: in a condition that the RFID is written on the label paper 22, firstly the RFID is written on the specified position of the label paper 22 and then the general printing processing is carried out. Therefore, the feed length is not counted in a condition that the paper D is fed forward or fed back for the writing of the RFID.

As described above, there are many modes of not counting the feed length. Therefore, the feed length is counted only when the print mode is a preset mode for counting the feed length, and the feed length is not counted when the print mode is a non-charge mode or when printing is not carried out during the conveyance.

According to the embodiments described above, the utilization amount of the label paper can be known according to the feed length of the paper D, and the charge can be carried out according to the feed length. In addition, the so far feed length can be also displayed or printed, and the utilization amount (namely the feed length or the charge) can be presented to the user.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printing apparatus, comprising:

a conveying section configured to move a recording medium fed from a paper roll along a conveyance path;

a thermal head configured to thermally transfer ink of an ink ribbon to the recording medium to print;

a control section configured to discriminate a print mode for the recording medium and control the printing processing for the recording medium; and a feed length counting section configured to count the feed length of the recording medium conveyed from the paper roll to the thermal head in a first direction when the print mode is a preset mode.

2. The printing apparatus according to claim 1, wherein the feed length counting section counts the feed length according to a pitch of label images to be printed on the recording medium and the number of printings.

3. The printing apparatus according to claim 1, comprising:

a presenting section configured to present at least one of the feed length counted by the feed length counting section and the charge set based on the feed length to a user.

4. A printing method, comprising:

moving a recording medium fed from a paper roll along a conveyance path;

thermally transferring ink of an ink ribbon to the recording medium by a thermal head to print;

discriminating a print mode for the recording medium and controlling a printing processing for the recording medium; and counting the feed length of the recording medium conveyed from the paper roll to the thermal head in a first direction when the print mode is a preset mode.

5. The printing method according to claim 4, wherein the feed length is counted based on a pitch of label images to be printed on the recording medium and the number of printings.

* * * * *